US006027463A

United States Patent [19]

Moriyasu

[11] Patent Number: 6,027,463

[45] Date of Patent: Feb. 22, 2000

[54] MUSIC MASSAGER

[76] Inventor: Hiro Moriyasu, 1314 SW. 57th Ave., Portland, Oreg. 97204

[21] Appl. No.: 08/774,900

[22] Filed: Dec. 27, 1996

[51] Int. Cl.[7] ..... A61H 1/00

[52] U.S. Cl. ..... 601/46; 601/47; 601/48; 601/57; 601/70

[58] Field of Search ..... 601/46, 47, 49, 601/56, 57, 58, 59, 60, 70, 48

[56] References Cited

U.S. PATENT DOCUMENTS

| | | | |
|---|---|---|---|
| 4,779,615 | 10/1988 | Frazier | 601/47 |
| 5,123,405 | 6/1992 | McShirley et al. . | |
| 5,215,078 | 6/1993 | Fulop . | |
| 5,235,967 | 8/1993 | Arbisi et al. . | |
| 5,247,925 | 9/1993 | Yamasaki et al. . | |
| 5,265,590 | 11/1993 | Takagi . | |
| 5,277,174 | 1/1994 | Schmidhauser . | |
| 5,304,112 | 4/1994 | Mrklas et al. | 601/15 X |
| 5,305,738 | 4/1994 | Shimizu . | |
| 5,311,860 | 5/1994 | Doria . | |
| 5,356,369 | 10/1994 | Yamasaki et al. . | |
| 5,437,608 | 8/1995 | Cutler . | |

FOREIGN PATENT DOCUMENTS

| | | | |
|---|---|---|---|
| 3237427 | 4/1984 | Germany | 601/47 |

*Primary Examiner*—Danton D. DeMille
*Attorney, Agent, or Firm*—Dellett and Walters

[57] ABSTRACT

The Music Massager is a system that interacts with a full spectrum of audio signals. The system contains, input process or band-pass discriminators, post processors including fixed or variable threshold detection, music beat pattern detectors, and beat enhancer to control vibrators. The post processor contains various syntheses of massage patterns, beat rhythm, dynamic non-linear signal operator, re-mapping of signal pass between detected band-passed signal to the output vibrator devices, combined with resynthesized vibrating action operates in concert with music or sound beat and rhythm. The system offers the user selectivity of vibrator modes to respond to easy listening, moderate or hard beating rock or jazz. The user beat pattern programmability allows it to customize the vibrator mood to be modified in tune with the user's mood and rhythm of the selected music.

15 Claims, 15 Drawing Sheets

(A)

(B)

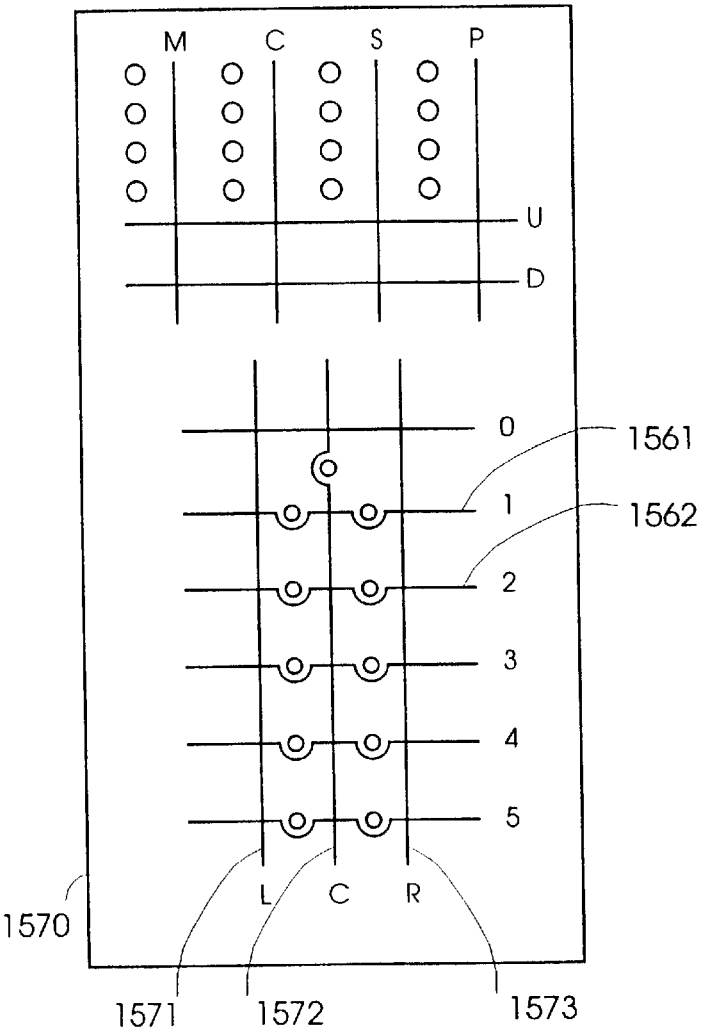
FIG. 13
FIG. 13B
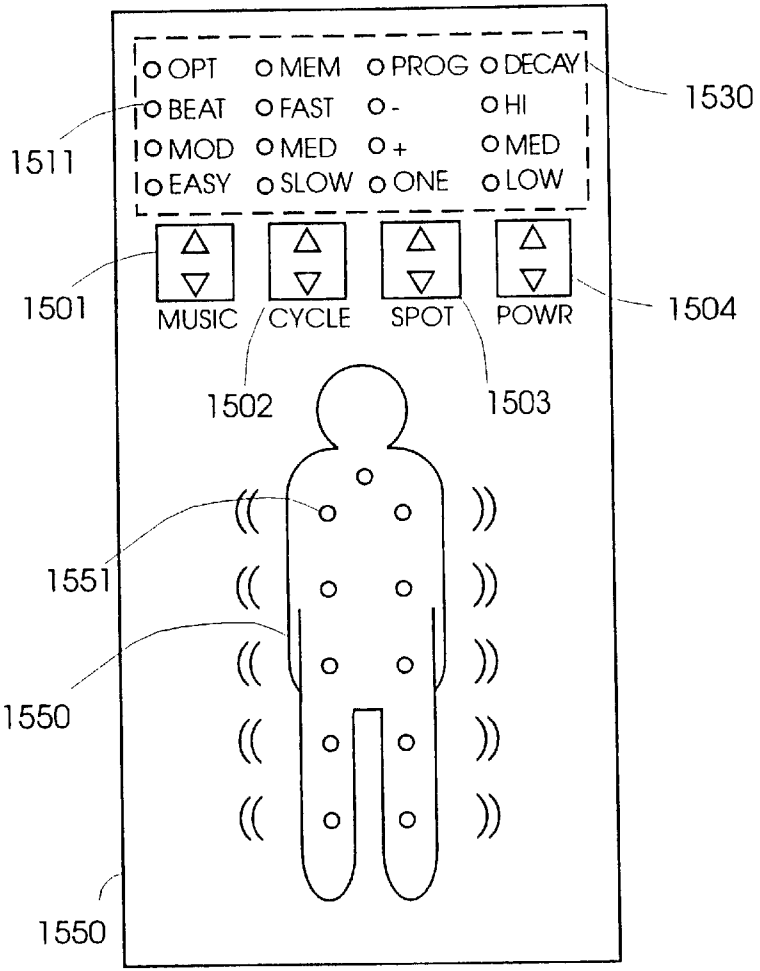
FIG. 13A

MUSIC MASSAGER

BACKGROUND OF THE INVENTION

In a fast paced—increased stress living environment, people find the need to relax more fully, than ever. At the same time, people demand more stimulus (e.g., higher, harder, and faster action). In the action arena, multimedia equipment has created sophisticated digital video technology, and digital audio technology.

There are two types of physical feedback required, relaxation mode and stimulus mode.

Music is known to aid relaxation and therapy. Through centuries of music composition, music can have a healing and/or invigorating effect. Countless composers and artists spent lifetimes devoted to the love of creating music. Through the more recent development of digital synthesized sound effects, virtually any type of music (relaxing or stimulating) can be created.

For relaxation, the music and the massager need to harmonize. For easy listening, the back massager needs to respond gently and soothingly to create a therapeutic experience to the user's mind and body. With a full scale orchestra playing an intricate musical composition, the vibrating massager needs to respond to the almost spiritual energy of such devoted musical artists. For stimulating music, such as rock, jazz or disco, the music massager needs to respond with spontaneous impact to the beat of the music and electrical—high energy, vibrating feedback.

There are various body vibrators that exist. Conventional body vibrators contain preprogrammed patterns and sequences which provide a mechanical massaging action. Such conventional vibrators do not operate interactively with the music. They operate completely independently, as though the massager has a mind of its own and is playing to a completely different tune. Just creating these repetitive, vibrating patterns for massaging the body soon becomes unsatisfying to the one being massaged. The result is much akin to listening to unskilled musicians.

In order for the music massager to be effective, the vibrating action needs to harmonize with the music's mood, beat and intensity. Merely creating a reproduction of music in a vibrating transducer is not enough. To provide satisfactory results a new technology is required to create a music massager that responds directly to all facets and frequencies of the musical performance.

SUMMARY OF THE INVENTION

A music massager and vibrator in accordance with the present invention connects to any audio or visual system to create a full spectrum of vibrating and massage action responding to different types of music. Additional massage actions are enhanced by synthesizing the beat and rhythm to modulate and accentuate. To accentuate the massage action to respond to different music types, such as easy listening, moderate impact, and high impact, there is added variable threshold detection, pulse-width modulation, beat and rhythm detection, and beat pattern synthesizer modulation of vibrators in the massager. This allows for the re-mapping of the music tone range or rhythm into the left, right or center channel for customized massage effects in the various body zones. The audio signal is processed through Band-Pass discriminatory means and the signal is further manipulated by rule-based signal processes to activate vibrating transducers. Post signal processing includes such operations as threshold detection, beat pattern detection and softening or accentuating depending on the type of music selected. The unit can also memorize user created beat patterns and playback such beat to modulate vibration action. Re-mapping of driving creates harmoniously enhanced and re-synthesized music into vibrator massage actions. The invention creates a full spectrum of master crafted music massaging satisfaction to the music listening user. This system operates in concert with audio signals from various audio/visual systems.

It is a principal object of the present invention is to provide improved methods of audio signal discrimination and to synthesize music into full-spectrum body massage action.

It is another object of the present invention to provide an improved massage with intensity to specific zones in response to musical instrumentation and how the music is performed by the musician(s).

A further object of the invention is to provide an improved means to detect the beat and rhythm of an audio signal to provide corresponding rhythmic massage action.

Another object of the invention is to provide an improved means to create the appropriate vibrator action to the type of music, such as easy listening, rock or jazz.

Still another object of the invention is to provide an improved broad spectrum, band-pass signal processing to control a massager.

Another object of the invention is to provide improved digital signal processing of incoming audio and create a modulated drive to a vibrator.

Another object of the invention is to provide improved routing and mapping of the sound spectrum to various vibrator zones.

Another object of the invention is to provide more distinguished left and right vibrator response to a stereo signal.

Another object of the invention is to provide an improved easy to use massage mode function, by allowing user control through touch and feel.

Another object of the invention is to provide improved remote audio signal coupling to eliminate cabling.

Yet another object of the invention is to provide improved remote control means for controlling most used functions of the audio/visual equipment from a single music massager controller unit.

The subject matter of the present invention is particularly pointed out and distinctly claimed in the concluding portion of this specification. However, both the organization and method of operation together with further advantages and objects thereof may best be understood by reference to the following description taken in connection with accompanying drawings wherein like reference characters refer to like elements.

BRIEF DESCRIPTION OF THE DRAWINGS

FIGS 13A and 13B illustrate touch key pads allowing direct addressing of vibrators in relationship to graphics of user's body and visual display of music vibrator strength.

DETAILED DESCRIPTION

Figure 1:
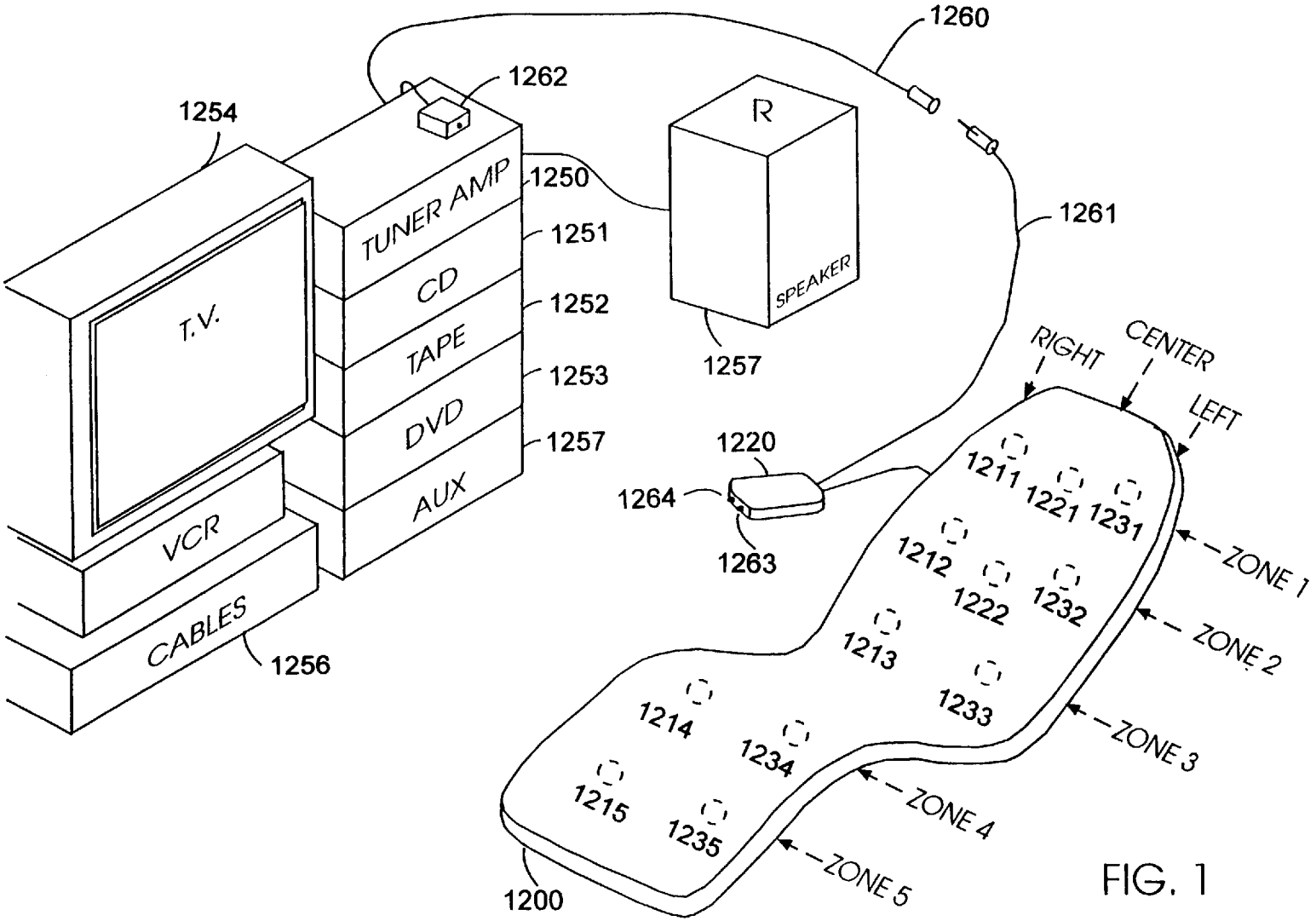
FIG. 1 pictorially illustrates a music massaging vibrator connected to an audio visual sound system.

FIG. 1 pictorially illustrates an interactive music massaging vibrator connected to an audio/visual sound system. Massaging mat 1200 contains vibrating devices, typically consisting of small DC motors with eccentric wheels, which are placed strategically to allow massaging action to various parts (zones) of the body. Vibrating devices 1211, 1212, 1213, 1214, and 1215 are suitably placed at the right side of the user's body mat. Vibrating devices 1221 and 1222 are placed at the center back portion of the user's body mat and vibrators 1231, 1232, 1233, 1234 and 1235 are placed on the left side of the user's body mat. For illustration purpose, the vibrators' positions are generally described as zone 1, 2, 3, 4, and 5 and left side, center and right side. With variation of mat sizes, the number and location of vibrators can be modified depending on the application. The hand held size controller 1220, accepts an audio signal from the home audio/video system 1250, 1251, 1262, 1254, 1255, 1256 and 1257, and video devices such as, TV 1254, VCR 1259, Digital Video Disk 1253 or cable 1256, with output audio signals related to the video image on a TV screen. If such an audio signal activates the vibrators, the vibrator action greatly enhances the multimedia experience of audio, visual and physical responses.

The audio signal to the music massager is connected at either the speaker output behind speaker 1257, the main amplifier's speaker output port or the earphone monitor output jack through pick off cable 1260. To allow mobility of the music massager and to eliminate necessity of hardwiring, a wireless transmitter 1262, may transmit an FM modulated audio signal to controller 1220's receiver 1264. Music Massager controller 1220, can contain IR receiver 1263 to receive command codes and re-program memory. After various remote codes are stored, the Music Massager controller can control all major functions of audio/visual equipment to simplify and orchestrate the total environment. Wireless audio channel transmitter 1262, also supports a multiple music massager system that contains wireless receivers and/or wireless private listening earphones (not shown). The proper routing of the audio signal processing of the left, right, center or surround sound channels to various body massage zones creates a soothing massage and stimulating sensation to the listener and viewer of video. Special signal processing, described hereinbelow, greatly enriches the total audio, visual and physical sensations to the user. Although a music vibrator massager system is illustrated with an external audio/visual system, it is possible to include internal audio sources as an integral part of the music massager system. Internal audio sources are built-in AM-FM tuners, CD and audio tape players, etc. Those skilled in the art can recognize that it is also possible to include or build in other types of audio sources, such as digitally recorded sound or music, synthesized music, sounds of nature, including the ocean, wind, rain, and animals, that create tranquil music with the music massager. Such features allow built-in music for the massager. Locally generated music or sound systems to operate the music massager system are within the spirit of the present invention and are covered in the scope of the present invention.

Figure 2:
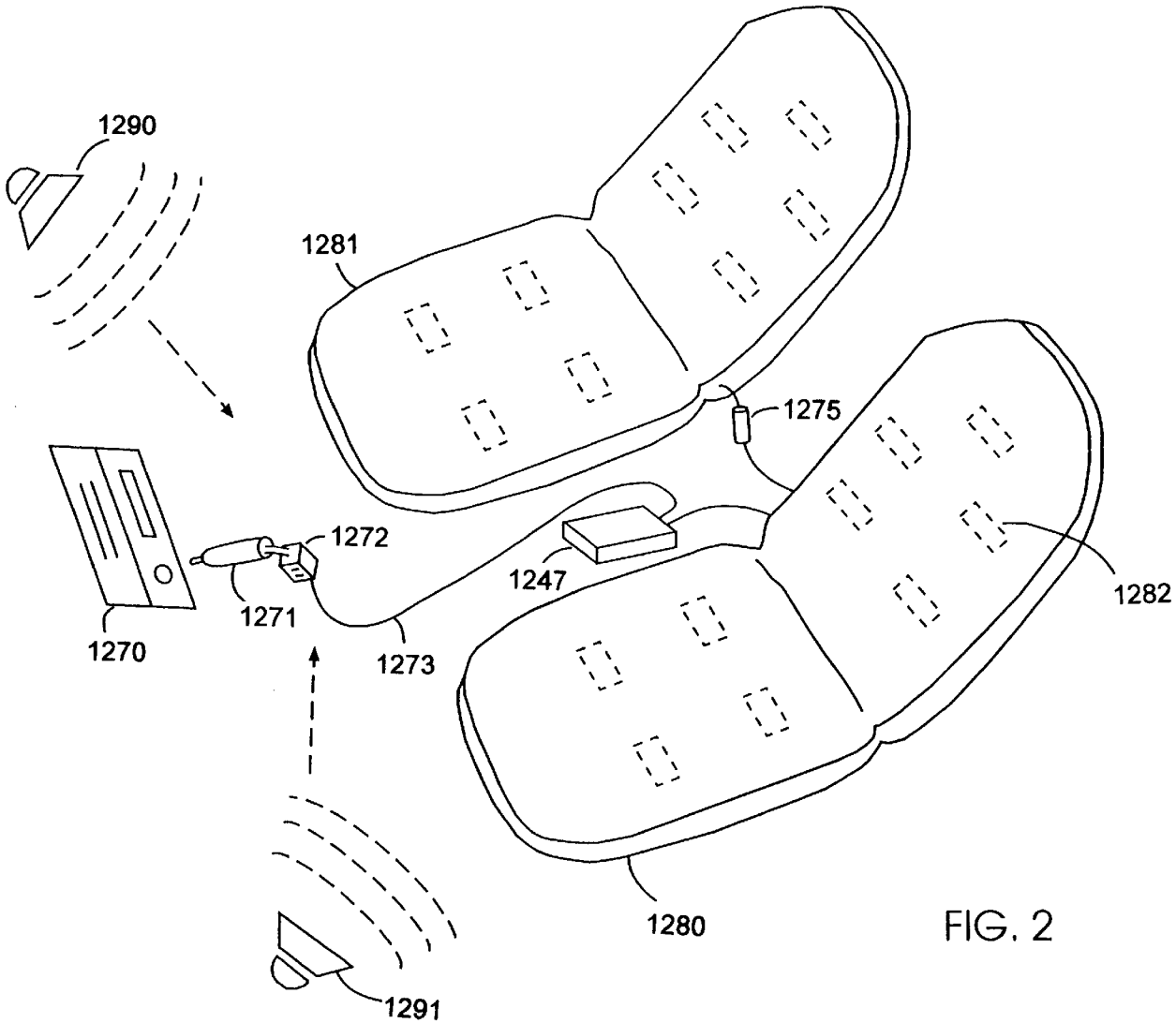
FIG. 2 graphically illustrates a music vibrator for an automobile, including a power plug and microphone.

FIG. 2 graphically illustrates the music massager and vibrator for automobile applications. Vibrating mat 1280, and companion mat 1281, contain multiple vibrating devices such as vibrator 1282. Power to the unit is supplied by Aux. power jack 1271, to controller unit 1247. The audio channel may be picked up at the automobile speaker connection. However, in some instances, wiring within the automobile may be cumbersome. To avoid such complexity, pick up microphone 1272, (mono or two microphones for stereo) with flexible coupling in the vicinity of or within the power plug can be used. Flexible coupling of the microphone from the power jack reduces the direct automobile vibration noise pick up through the power jack. If the microphone(s) is placed in the power jack case, vibration isolation media to float the microphone is desirable to reduce noise pick up. The left and right side microphones are directed toward right speaker 1290, and left speaker 1291, respectively. The audio signals may be connected to the controller box in the same cable bundle as power cable 1273. An optional companion vibrating mat may be connected through addition connector 1275.

Controller unit 1247, allows various music and sound effects enhancements to produce accentuated bass and beat boost to the music massager. For example, for relax mode, responses can be adjusted to easy listening mode. For accentuating high impact music, the audio bass region of sound can activate accentuated vibrator actions. The music massager vibrator can be activated with audio below the sub-audible region where the normal ear can not hear. The body can feel the strong-beating vibration caused from this sound range If the sub-bass region of the signal is boosted, in the audio equipment, it can greatly enhance the high impact music vibration experience. The conventional approach of mounting a high power sub-woofer below the driver's seat requires 50 to 100 watts of audio power and additional high power amplifiers of greater than 100 watts. This sub-woofer approach can often create undesirable audio pollution to the environment. Furthermore, audio speakers are indirect (air coupling) and coupling efficiency is very low. The music massager with bass and beat enhancer overcomes these conventional limitations.

Figure 3:
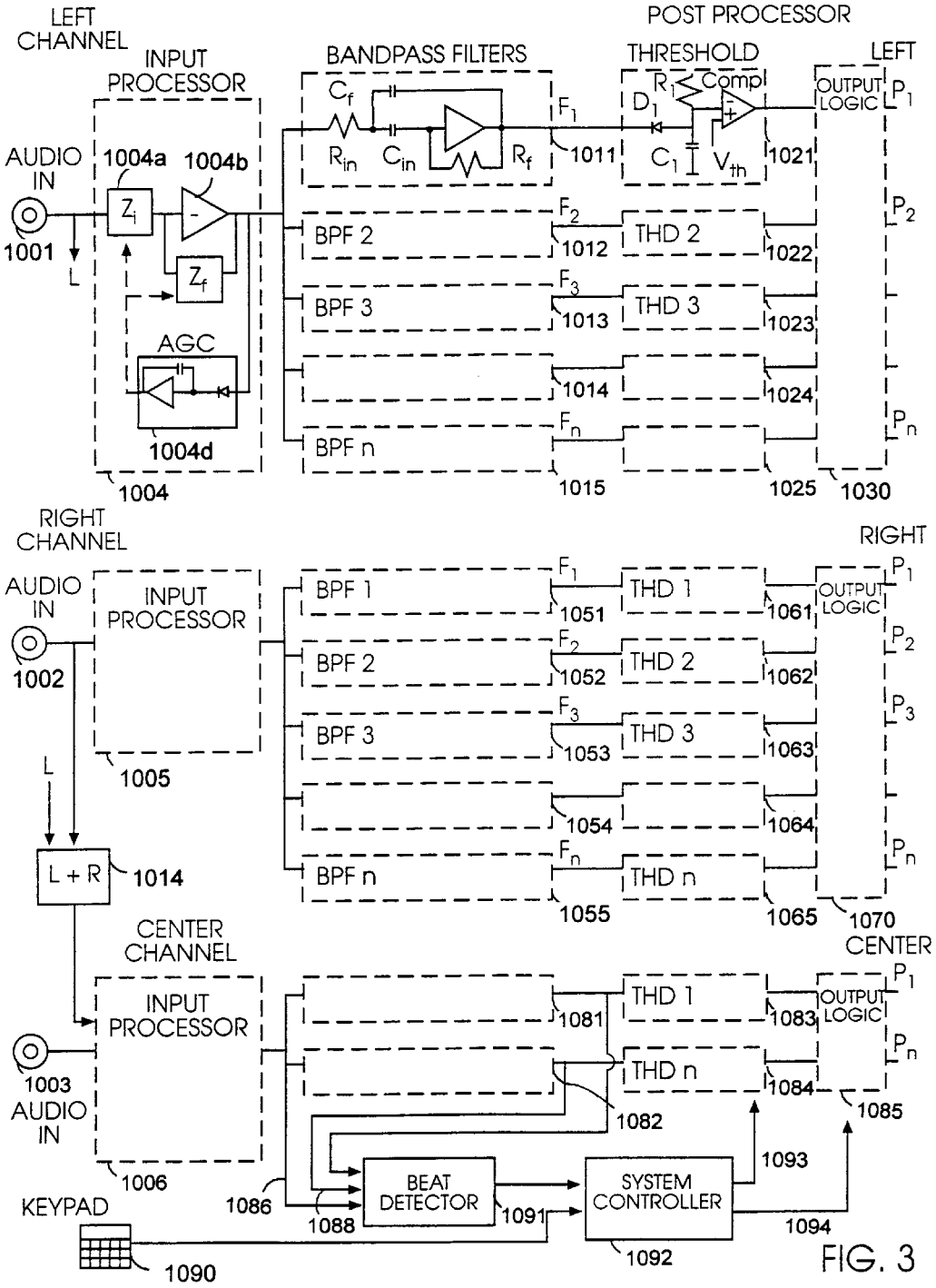
FIG. 3 illustrates schematically audio band-pass discrimination and post processor to drive various vibrating devices.

FIG. 3 illustrates schematically the use of audio band-pass discrimination and post processor to process and apply various driving signals to vibrating devices placed in the vibrating mats. Audio signals are applied to left, right and center input terminals 1001, 1002, and 1003. These signals are then applied to input processors 1004, 1005 or 1006 which contain input amplifiers. The signal level is controlled by means such as variable resistor potentiometers or Automatic Gain Control (AGC). The input processor can also contain certain functions such as noise filters, bass or treble boosting circuits. AGC can be accomplished by various well-known methods, such as the use of variable resistive elements like biased diodes, FETs, photo cell activators and LEDs. Typically the AGC circuit detects the peak signal level or DC average of the modulated wave form at the output and provides negative feedback to reduce gain.

The normalized signal from the input processor is applied to the input of several Band-Pass Filters, (BPF 1, 2, 3, 4, n) 1011, 1012, 1013, 1014, and 1015. The BPF may be implemented using various well-known methods, such as passive filters (not shown), active filters, or switched capacitor filters (not shown). Left channel BPF 1, 1011 shows an example of an active filter consisting of an input resistor, Ri, an input capacitor Ci, a feedback capacitor, Cf, a feedback resistor, Rf, and an amplifier. The corresponding capacitance and resistance values will select a particular center frequency of the BPF.

BPF 1 through n, 1011 through 1015, typically have a Q factor in range of 2 to 6 and have reasonable selectivity. A higher Q factor will achieve a higher selectivity to a particular tone within the frequency band. The output of each BPF is fed to post processors, such as Threshold Detectors 1021, 1022, 1023, 1024 and 1025 and to the output logic processors 1030, 1070 and 1085. The logic processor provides a driving signal to activate the vibrating devices that are placed in the vibrating mat (not shown).

Threshold detector, THD 1, 1021 discriminates amplitude and event occurrence and creates a pulse that represents the amount of the audio signal. The output from the THD is converted to digital pulses of one and zero. The pulse width represents the strength of a particular audio frequency in the band. Digitally converted pulses are then processed by the output logic processor to perform further logic and routing of driving signal to the vibrators in the mat.

The right channel audio signal input through audio in 1002, is processed via the input processor 1005, a series of BPF 1051, 1052, 1053, 1054 and 1055, Threshold Detectors 1061, 1062, 1063, 1064 and 1065 and the output logic processor 1070. The resultant output drive pulses P1, through Pn will drive the set of vibrators through the power drivers (not shown). The left channel output is generated in a manner corresponding to the right channel output. The center channel audio, if available, may be applied to the center audio in 1003, or computed as a composite of the left and right channel signals by the add-subtract module 1014.

During the original stereo production the left side of the music is recorded into the left channel. The right side of the music is recorded into the right channel. However, the center music or voice is typically recorded into 50% to the left and 50% into the right channels. Knowing the center stage music or sound from the original is mixed into and recorded into the left and right channels, it is possible to reconstruct the center stage sound or music by adding the left and right channels. However, if the left channel is subtracted from the right channel, the original center stage sound or voice is eliminated, or at least substantially reduced. In some cases, the ratio of the mix or the phase and time delay can be added or subtracted to detect the exact position of the music instrument or voice in the stage or position in respect to the recording microphones. Detecting the delay time, phase relationship of audio signals allows surround sound effects and such may be used to activate the enhanced vibration to accentuate the physical sensation.

This subtraction feature is desirable as a way of eliminating the response to vocal sounds, such as a TV announcer's voice. The center channel input signal is processed through the center channel input processor 1006, BPF 1081, 1082 and post processor 1083, 1084, and 1085, to produce center channel output signal P1, and P2. Key pad 1090, placed on the controller unit, selects the mode control to system controller 1092. The system controller 1092, detects beat information from beat detector 1091, and controls the post processors, control sequence, and the strength of output drive modulation via THD and output logic unit.

People often respond differently to certain music. For example, one user may want to tap their hands or feet to the beat or rhythm. Instruments, such as a bass guitar, bass drum, high pitch drum, high-hat or tom-tom can create the beat and rhythm in music. Such a beat is electronically detected and added to the vibrator modulation to simulate tapping or body swinging actions.

Figure 12:
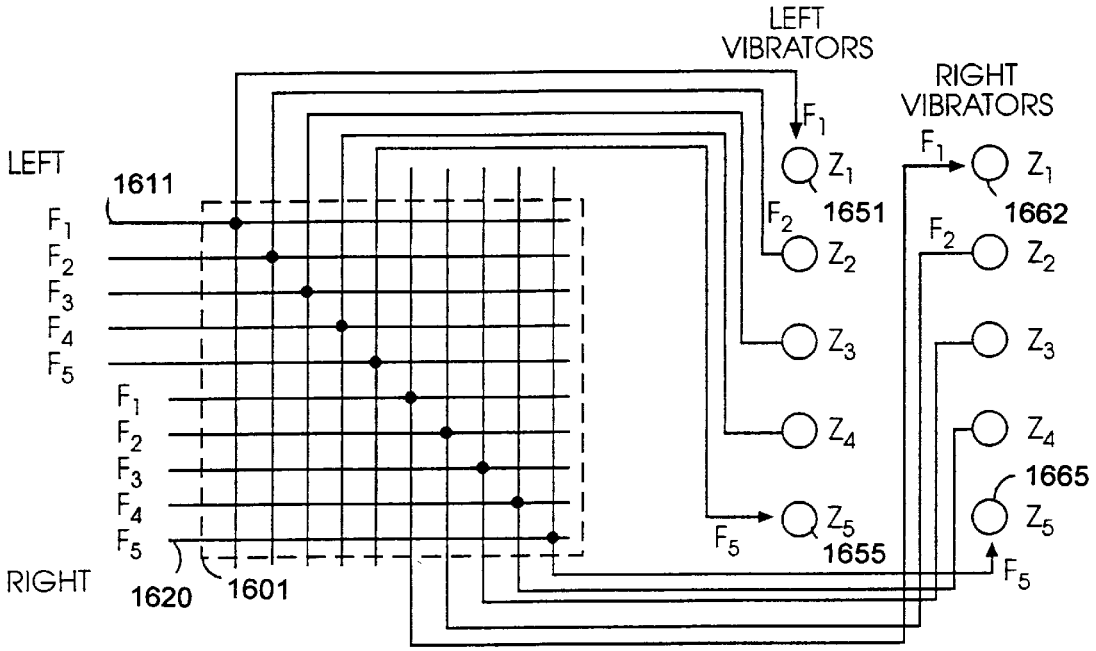
FIGS. 12A and 12B illustrate signal mapping between detected band-passed signal and targeted zones of vibrator.
Figure 12:
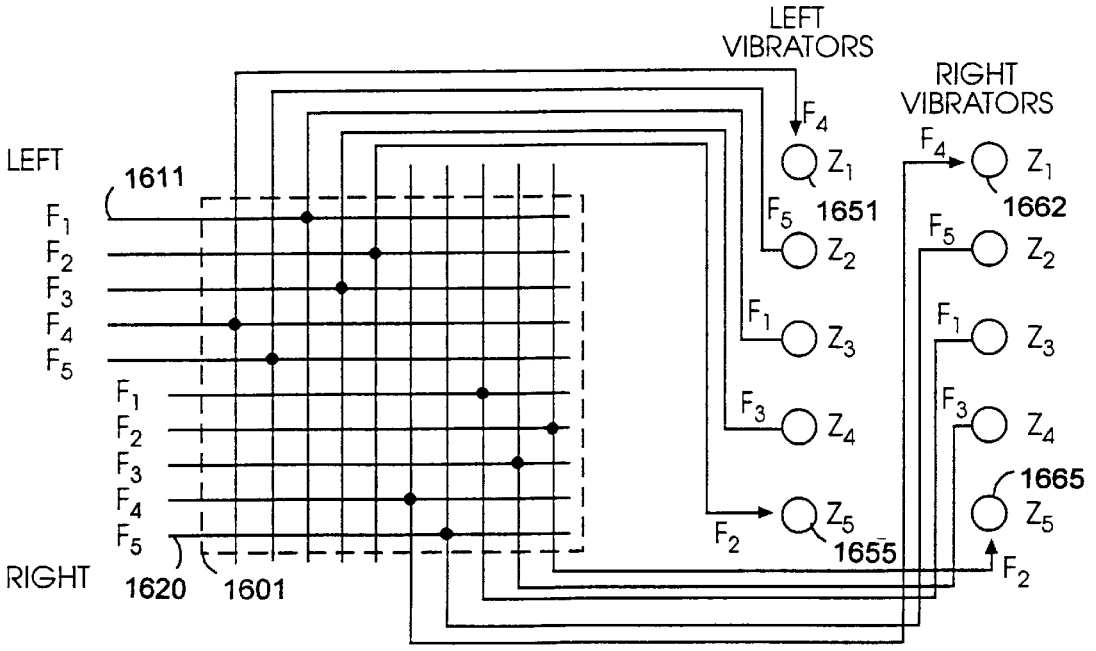

The user can also create their own beat combination pattern of left, right, short or long beat using the touch key pad. Patterns are stored in the beat pattern memory in the system controller. The user created beat and rhythm patterns can be played back for a synthesized tapping, body shaking effect with music. If various beat and rhythm modulation is added it will greatly enrich the music massage experience. The beat detector 1091, receives a composite audio signal from the input processor 1006, and the outputs of BPF 1081, and 1082. The beat detector contains an envelope peak detector level, crossing, and phase lock-loop beat pulse generator (explained in greater detail hereinbelow in conjunction with FIG. 12).

The beat detector, system controller, and post processor perform certain rule-based post signal processing between the detected signal from the BPF and vibrators to provide an enhanced, re-synthesized full spectrum massage operation. Through rule-based system controller, output logic processing functions may be implemented by discrete logic or micro processor. The basic analog band-pass processing and post processing methods to drive various vibrating devices placed in the music massager mat may be implemented by Digital Signal Processing (DSP) micro processors and software algorithm, described next.

Figure 4:
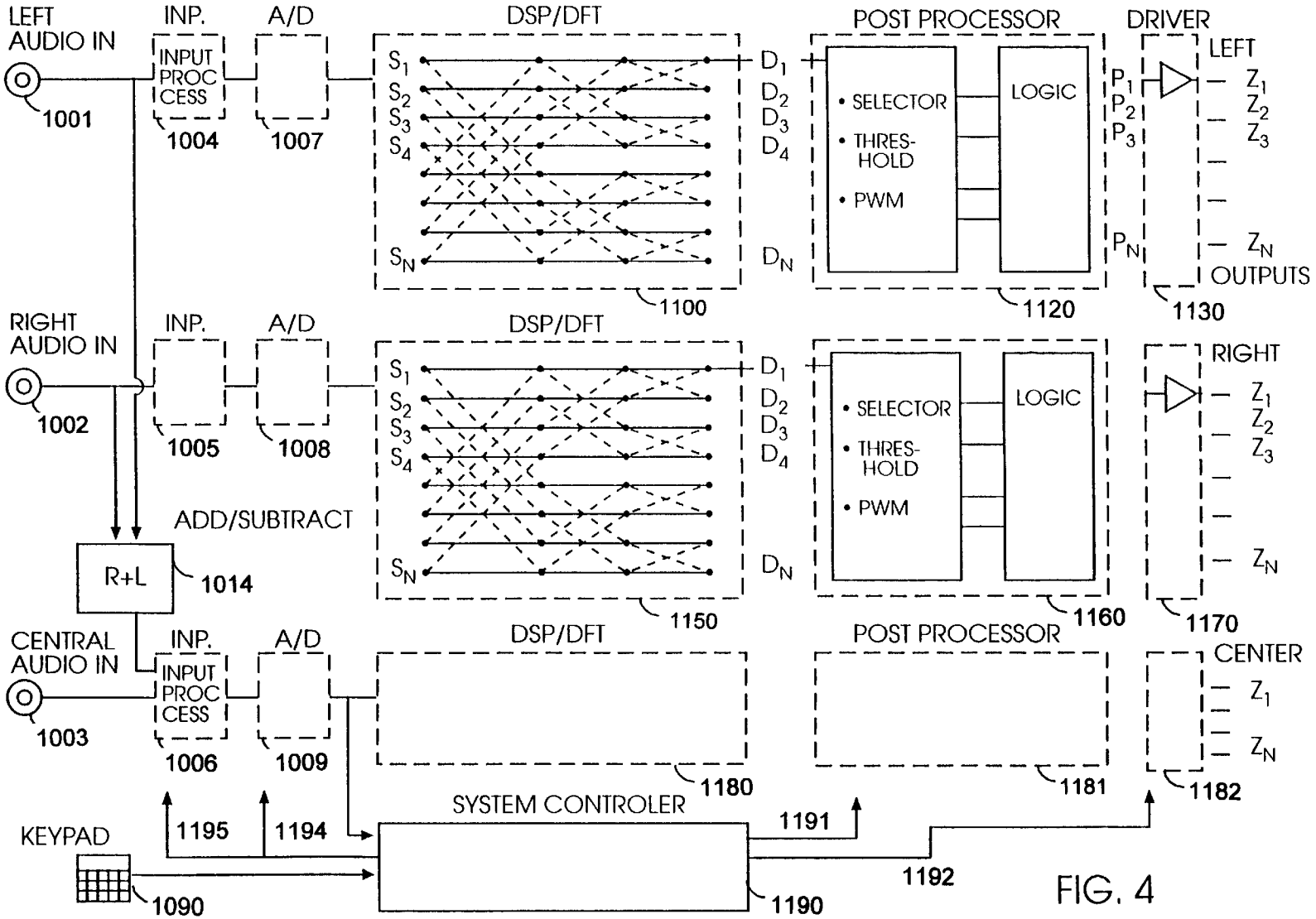
FIG. 4 illustrates audio signal processing and post processing, using DSP processor and/or microprocessor.

FIG. 4 illustrates a block diagram of the digital music massage processing system using DSP and or micro processors. Audio signals from left 1001, right 1002, and center 1003 (if available) are applied to the input processors (INP) 1004, 1005, and 1006 to normalize gain and bass and equalize the high frequency before being fed to the Analog to Digital converter, (A/D) 1007, 1008, and 1009. The sampled audio signals S1, through Sn represent an audio signal discrete time sampled sequence that will be processed by DSPIDFT blocks 1100, 1150, 1180.

Figure 9:
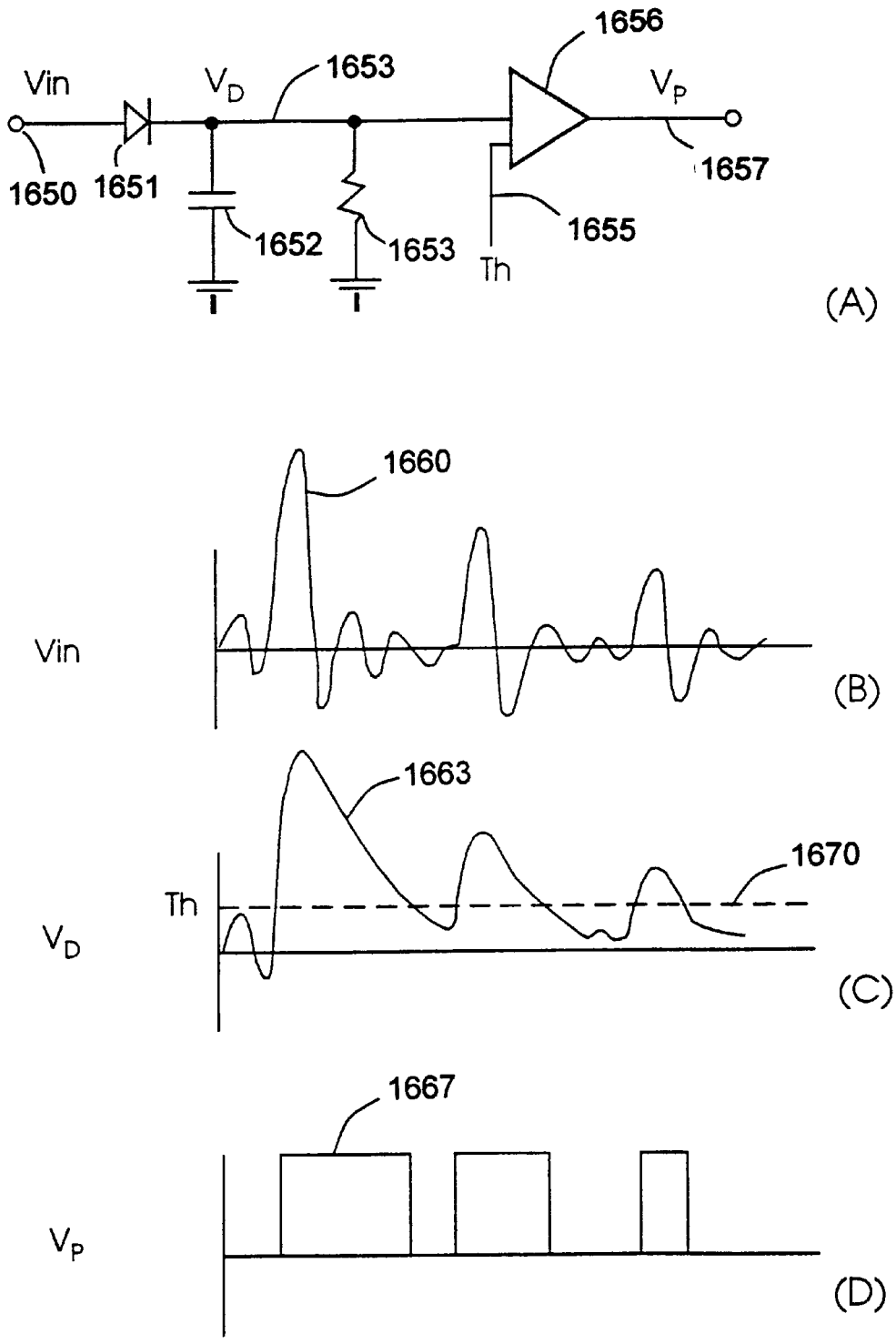
FIGS. 9A–9D illustrate an amplitude to pulse width modulation circuit and wave forms.

Numerous Fast Fourier Transformers (FFT) may be implemented in the software. They are also available in hardware DSP chip form. Sampled time data S1 and Sn are transmitted through real and imaginary operators or twiddle factors. They are summed at the end to result in amplitude which represents the amplitude of signal at a discrete frequency region D1, D2 and Dn. Since various FFT and DFT methods are well known, further details will not be described here. In order to obtain frequency data, at least two frequency samples are required. Also, in order to cover high frequency to lower frequency bands, the total number of samples needs to be increased accordingly. The selected frequency range data is passed to the digital post processor 1120, which will determine the threshold value by converting the amplitude to pulse width modulation. The post processor further performs the logical operation (signal multiplexing) and re-routes the signal to the vibrator driver 1130, thus the vibration is placed in various zones. More details are described herein in connection with FIG. 9 and FIG. 10.

The left channel audio input 1001, is processed through INP 1004, A/D 1007, DSP/DFT 1100, post processor 1120, and driver 1130, to drive the set of vibrating transducers. The signal applied to the right channel audio input 1002, is similarly processed to provide vibrating drive outputs at the right driver output module 1170. The center channel audio input 1003, is also processed similar in a manner. If the center channel audio signal is not available, the right channel and left channel audio signal are added to create a composite signal. The key pad 1090, selects the mode and function for the system. The system controller accepts the commands from the user through the key pad and controls the various functions. The vibrators in the mat are driven by the power driver modules.

Figure 5:
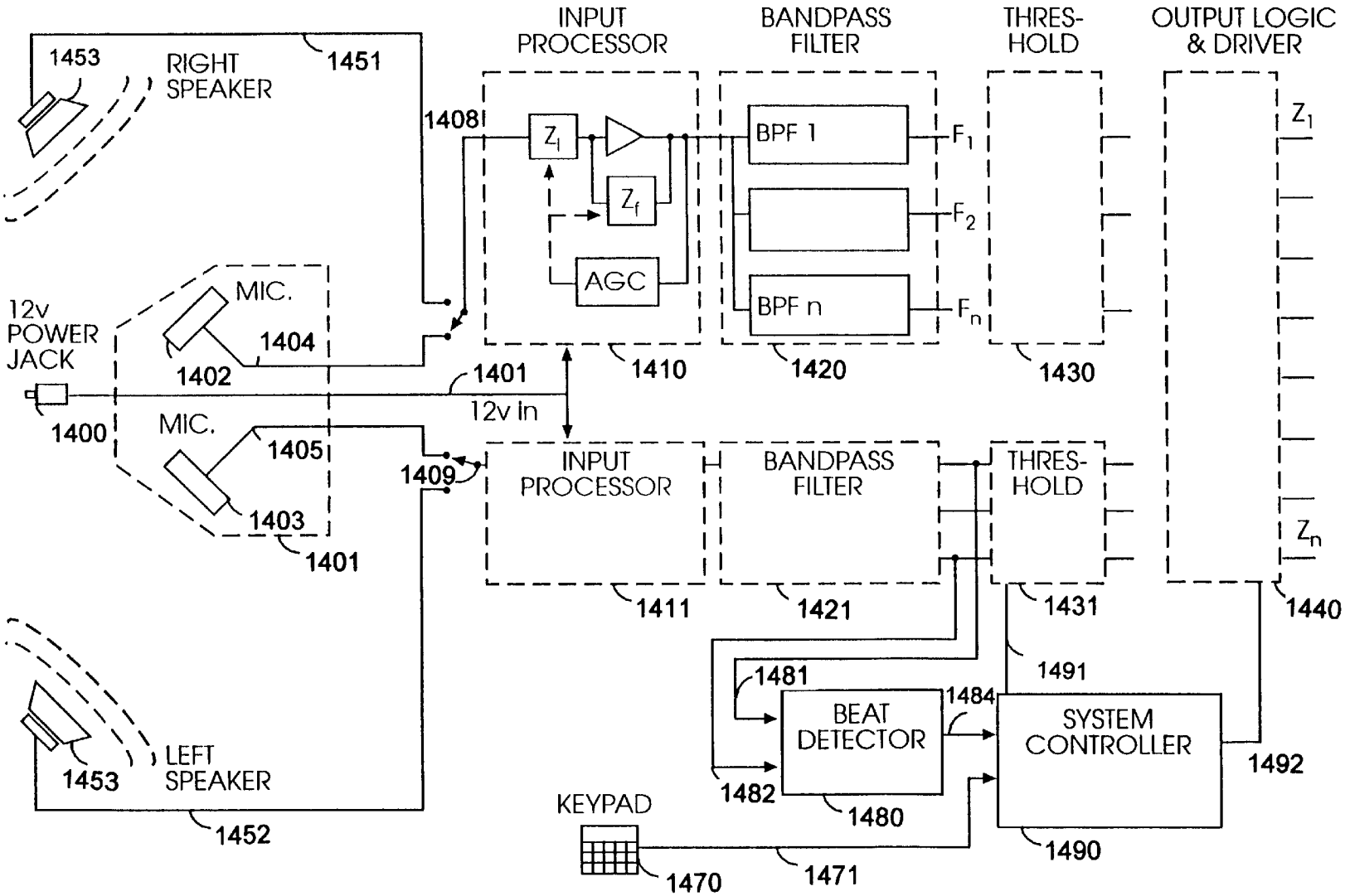
FIG. 5 illustrates a block diagram of a music vibrator with auxiliary power and microphones.

FIG. 5 illustrates the block diagram of the music vibrator massager that contains an additional microphone (pictorial illustration was described in connection with FIG. 2). Automobile or portable applications may require a microphone pick up to simplify the wiring. In the auto application, microphones 1402, 1403, are placed within the vicinity of AUX. power pick up plug 1400. The microphones are attached to the wire in the vicinity of the AUX. power jack by a flexible coupling. The audio signal cables 1404, and 1405 are routed to the control, suitably via the same cable bundle as the power cable 1401, to simplify the design and reduce cabling complexity. If the user chooses to hard wire, the audio signal may be connected directly to the right speaker 1453 via cable 1451 and left speaker 1453 via wire 1452. Left and right channel signals are processed through input processors 1410, and 1411. Then the signal is fed into the BPF 1420, and 1421, and to the threshold detector and processor 1430 and 1431. The signal is then input to the output logic and driver module 1440, to generate pulse-width modulated signals to the applicable vibration devices in the mat. The key pad 1470, selects the mode and various functions through wire 1471, to the system controller 1490, which controls threshold detectors 1430, and 1431, through wire 1491, and output logic driver 1440, via wire 1492. The beat detector 1480, typically monitors the high and low frequency amplitude from BPF 1421, via wires 1481 and 1482. The beat detector and rhythm generator produce the basic beat and higher frequency harmonic beat. The system controller will modulate various zones of the vibrator to accentuate the beat and rhythm of the music. A high power pulsating beat is desirably obtained to add a high power response if the sub-bass frequency is boosted by the beat generator, thereby delivering a much more accentuated vibrating response to the user. It will thus overcome the limitation of low efficiency of the conventional sub-woofer drive method.

Figure 6:
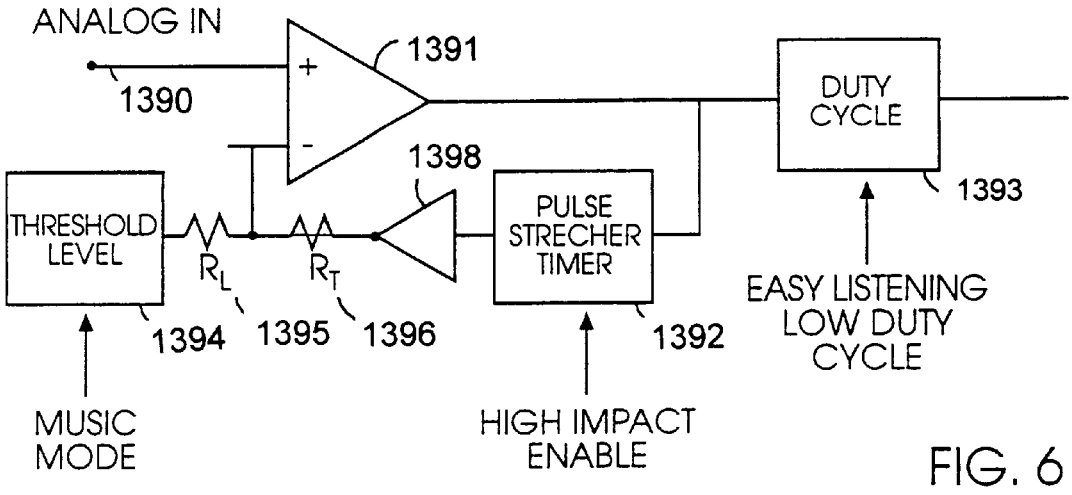
FIG. 6 shows simplified schematics of threshold detection, beat detector and enhancer.

FIG. 6 illustrates schematically the adjustable threshold detection, the high impact pulse enhancer and duty cycle modulation to tone down the response to the music. It is desirable to create vibrator responses to match different types of music. For example, with easy listening or light classical music, a softer, more gradual vibration response is soothing. In contrast, rock, jazz, and disco-like music is stimulating and demands a high energy, high impact response.

For the easy and soft music mode the comparator threshold 1394, is set low. The comparator detects and responds to the minute music tones and passes the signal through duty cycle generator 1393. The duty cycle is set low to provide a gentle response to the vibrators. In this soft music mode, the pulse stretcher is disabled (wave-forms are shown in FIGS. 7A–7E). Still referring to FIG. 6, if rock or high impact music is selected, the threshold level 1394 voltage is set to a higher voltage so that the low level signal is not detected. However, the audio analog signal level of rock music exceeds a high threshold bias. The pulse stretcher timer 1392, is triggered, then the inverter 1398, drives the threshold-bias voltage greatly below the normal threshold level. This will enable a much greater portion of the analog wave to pass through the threshold comparator 1391. The accentuated high-level pulse will pass through the duty cycle generator 1393, set for high duty cycle resulting in a high-duty cycle drive signal being sent to the vibrator (wave forms are shown in FIGS. 8A–8D).

Figure 7:
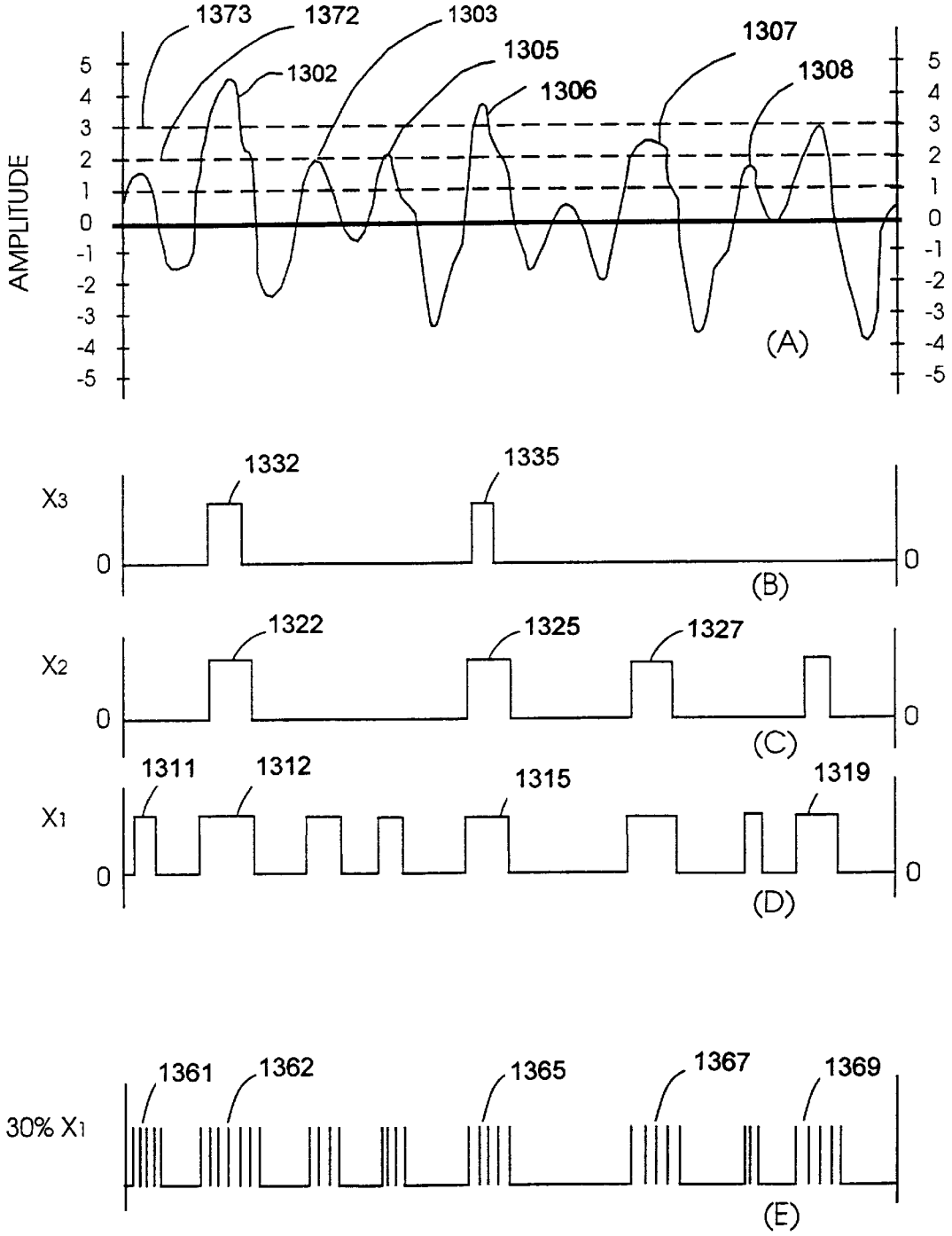
FIGS. 7A–7E illustrate threshold detection of audio signal and creation of various pulse-width modulations to achieve vibrator response.

FIGS. 7A–7E conceptually illustrate the threshold detector output responses with various threshold comparator bias voltages. The wave form in FIG. 7A shows an incoming analog wave form to a threshold detecting comparator. For illustration purpose the audio signal has DC level of zero and peak to peak voltage of plus or minus 4 volts.

If the threshold bias is set high at +3 volts, which is shown in the dotted line 1373, any portion of the input signal below 3 volts will not generate an output high. If the input signal exceeds 3 volts or high threshold, such as wave form portion 1302, it will produce X3 pulses as shown in FIG. 7B. Another input wave portion 1306, also crosses above the high threshold of 3 volts resulting in a high pulse, 1335 in X3.

If the threshold bias is reduced to 2 volts, at 1372 level, then the comparator passes through any portion of input signal above 2 volts, resulting in increased number of X2 pulses, 1322, 1325, 1327, etc., as shown in FIG. 7C.

If the threshold is further reduced to a 1 volt level, a larger portion of the pulses cross resulting in X1 pulses as shown in FIG. 7D. If the X1 signal is passed through a low duty cycle module, the result is that finer and lower energy pulses are created, as show in 30% X1 in FIG. 7E. This will give a signal to the vibrator for a finer soothing massage.

FIGS. 8A–8D illustrate wave forms of a high-impact pulse width modulated signal through the threshold detector.

To provide an accentuated response to high energy music, such as rock, jazz and disco music, the comparator threshold is normally set high at +3 volts as shown in the dotted line 1343. Any portion of input wave form exceeding +3 volts is shown in FIG. 8B, as generated X3 high pulse signal 1332, and 1335. If these pulses are applied to the pulse stretcher or timer (shown at 1392 in FIG. 6) stretched pulses Xs, 1372 and 1375 (FIG. 8C), are produced.

If the stretched pulse Xs forces the comparator threshold level to an even lower threshold voltage, such as −1 volt lower dotted threshold line 1340, in FIG. 8A, a much greater portion of input wave in FIG. 8A, will pass through the comparator. The resulting output of comparator, Xe, is shown in FIG. 8D.

Figure 8:
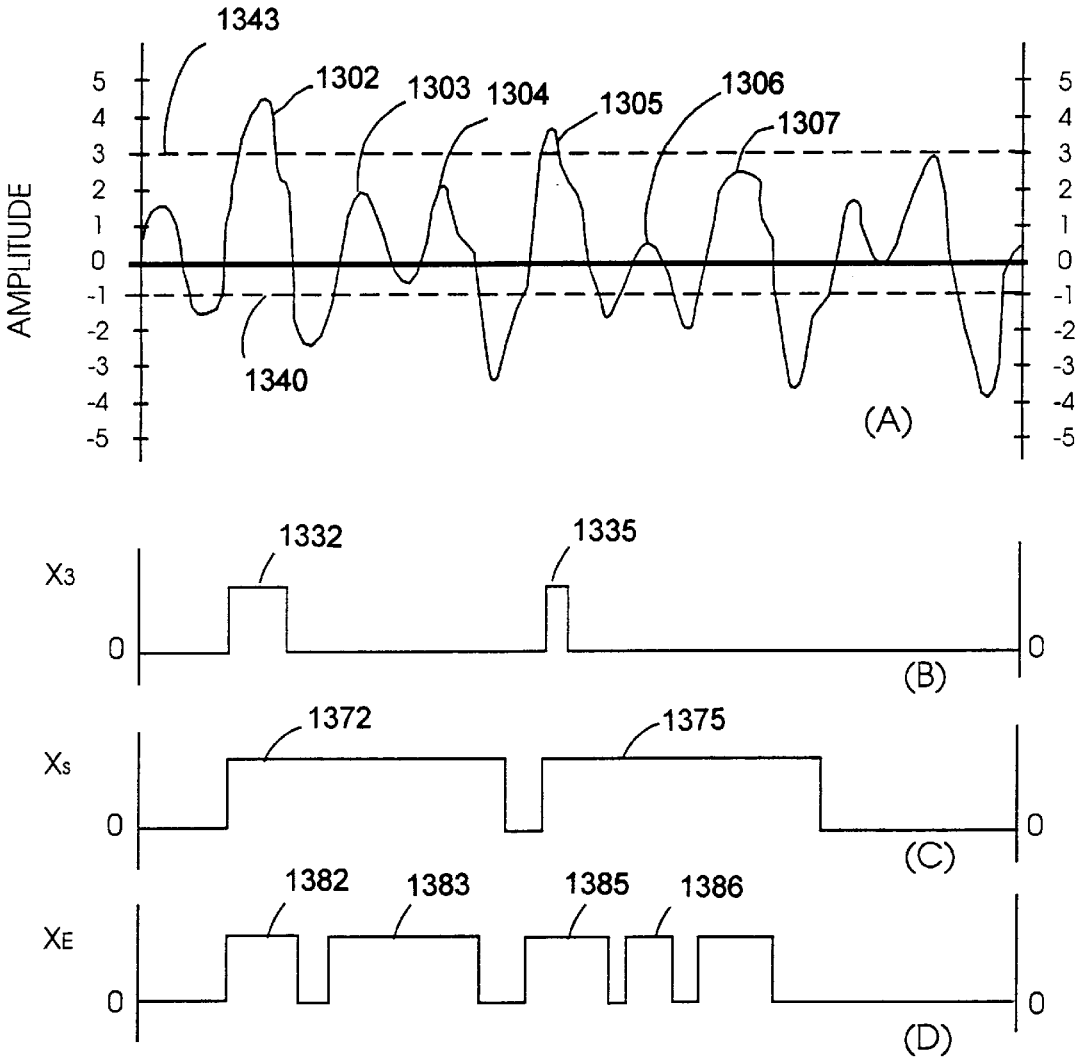
FIGS. 8A–8D illustrate wave forms showing threshold detection and pulse modulation to create high impact vibrator response.

As illustrated in FIG. 8, the high impact response can be created by a higher peak level signal thus increasing duty cycle of pulse sequences.

FIGS. 9A–9D illustrate an example of an audio threshold detector that detects the peak value of incoming analog signal and produces modulation. Referring to the schematics shown in FIG. 9A, the analog signal Vin is applied to input terminal 1650. The positive going signal will pass through diode 1651, and charge capacitor 1652. Next, the peak charged signal is discharged by resistor 1653. An example analog signal, Vin at the input terminal 1650, is shown in FIG. 9B. The voltage Vd 1653, appearing at the capacitor and input to comparator 1653, is shown in FIG. 9C. The comparator compares the input signal with the threshold voltage, Th 1655, and produces the output high whenever the input voltage is above threshold voltage.

As is shown in FIG. 9C, the high value signal 1660, takes a longer time to decay 1663. This slowly decaying signal crosses the threshold level of 1670, thus producing wider pulse width 1667. If the peak signal is reduced, it takes a shorter time to cross the threshold level, producing shorter pulse is width at the output of the comparator.

As is described previously, adjusting the threshold level higher allows the comparator to detect only high signals. This type of threshold detector also may be used to create a moderate vibrating effect by lowering the threshold and duty cycle at the output.

Figure 10:
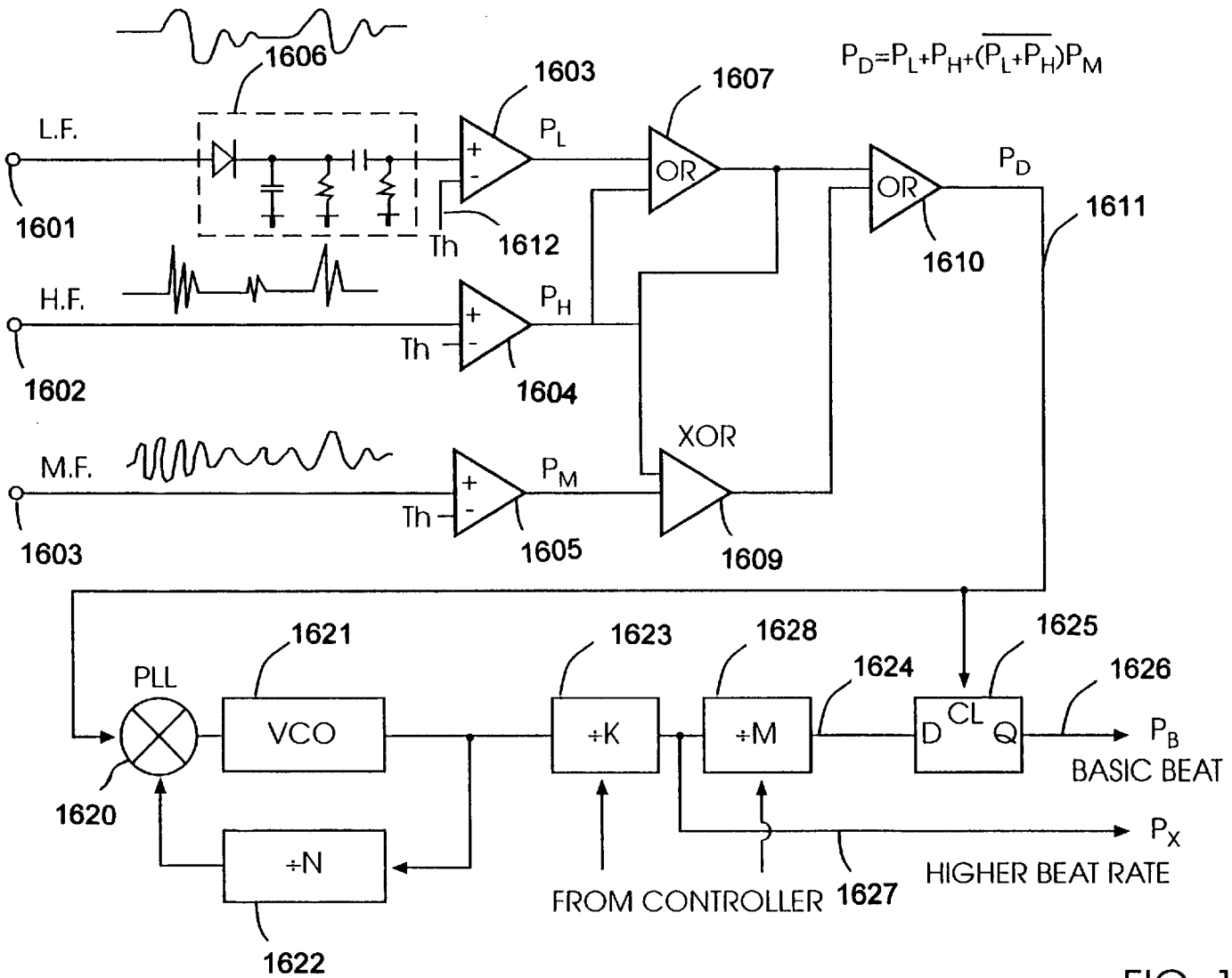
FIG 10 illustrates beat detection and beat rhythm generator.

FIG. 10 illustrates schematically a method of detecting audio signal beat or rhythm and creating a new basic beat and higher beat rate.

The music listener often responds to certain music with hand or toe tapping. Certain music types, such as rock, jazz, and disco, have a strong beat. The audio beat rate detection may be achieved by detecting the low frequency component applied to the L.F. input 1601, the signal envelope detector 1606 (shown in the dotted block) and the comparator 1603. This will detect the high portion of L.F. The envelope detection may be accomplished, for example, with a peak detector diode, control decay capacitor and resistor.

Likewise, a high frequency signal H.F applied at 1602, produces PH at output of the threshold comparator 1604. A mid-range frequency signal that is applied at 1603, generates PM at the output of comparator 1605. Most of the beat is generated by low frequency drum or bass guitar-like instruments as well as high pitched drum at high frequency. Mid-range contains vocal and other instruments that do not enhance the desired beat. To minimize, or eliminate the mid-range signal, further logical operations can be performed using high and low frequency beat signals. The detected incoming signal PD 1611, can be generated, for example, by performing the logic operation

PL OR PH OR PM AND NOT (PL OR PH)

on the generated signals. The feedback loop containing VCO 1621 and divided by N (1622) causes VCO (1621) to output a pulse which is N times greater than the input pulse to PLL from PD (1611). VCO 1621 typically contains an integrator to slowly adjust and lock the pulse rate from PLL. 1620

Using the created higher beat rate at the VCO output and dividing down again, a lower modulo frequency is generated. Divide by K block 1623, and divide by M block 1628, create this modulo rate frequency. This modulo signal is fed to a D Flip Flop 1625 and clocked by the PD 1611. This will create a high or low pulse sequence. If the product module divider K and M, are equal to N=K*M, then the new output rate is equal to the incoming beat rate. If the product of (K*M) is greater than N it will create beat change with slower rate, which will be, synchronized to the incoming beat rate. If such a sub-beat rate is applied to modulate the strength of the left or right of a selected zone, it can create a sequence of left and right tapping-like sensations. An example is a rhythm-like sequence of left, left, right, left, right; long left, short right; right, right. Such programming is fed to modulate the output strength of the left side and right side zones and will create added, intriguing, synthesized beat modulation of vibrator response. Additional, small, randomizing variations may be added to divider K and M to create even more intriguing beat variation to the music massager. Typically, N=2 to 9, for example, for 3 or 4 note music.

Figure 11:
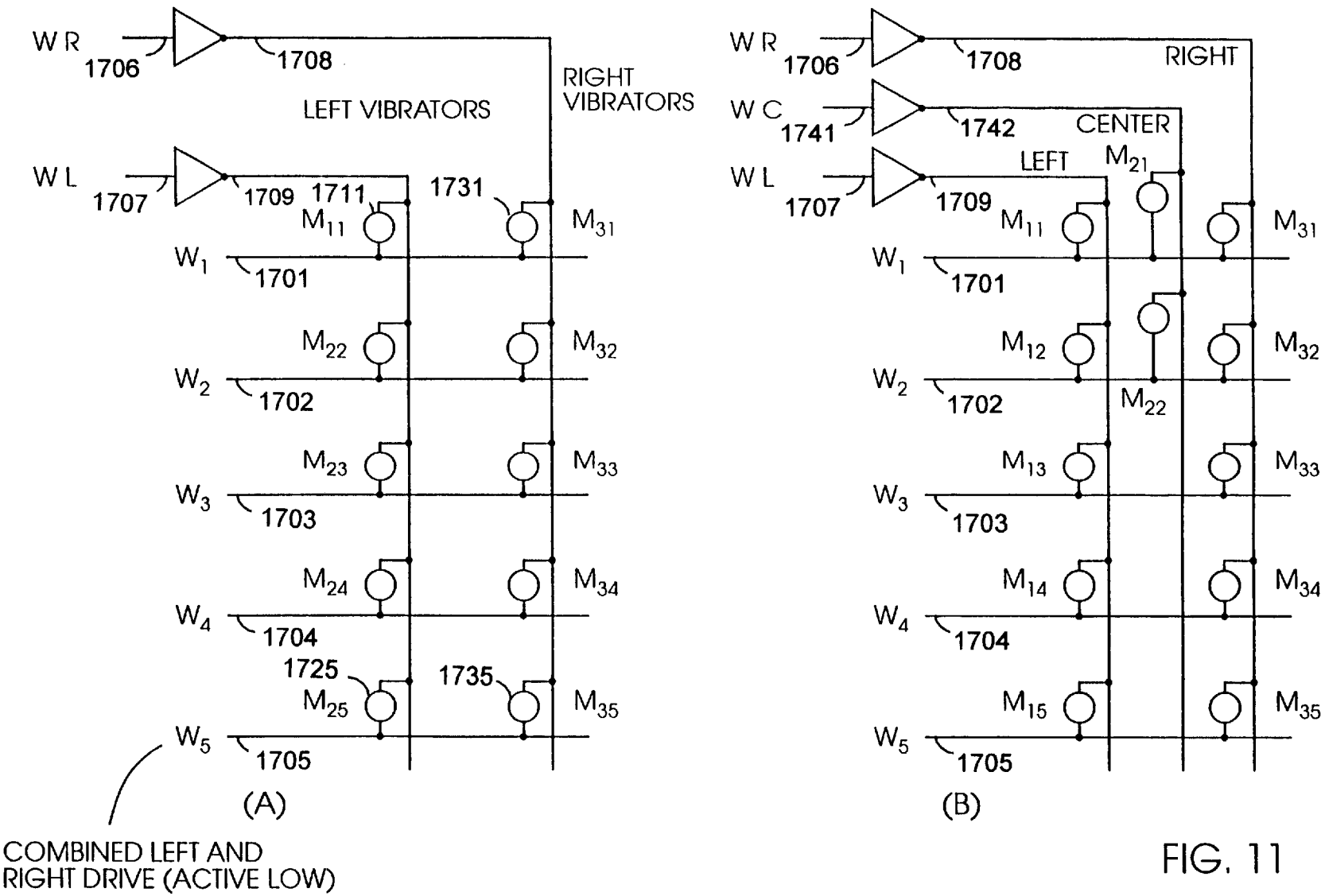
FIGS. 11A and 11B show matrix drive of vibrating motors.

FIGS. 11A and 11B illustrate multiplexing of vibrator drive to reduce the number of cabling requirements. For example, to drive 5 zones of left, center and right it will require 15 drive cables plus a common power line. Multiplexing will reduce the amount to 8 wires, by driving high side and low side.

FIG. 11A shows 10 vibrators driven by low side drive signals, W1 through W5, 1701 through 1705. The high side drive WR, 1706, and WL, 1707, provide the left and right side of the vibrators, M11 through M15, 1711 through 1715, and M31 through M35, 1731 through 1735, respectively.

FIG. 11B illustrates the center high side drive signal WC, 1741, and the driver will drive the high side of M21, and M22. The matrix cross bar selection methods are well understood and broadly used to reduce cabling problems.

FIGS. 12A and 12B illustrate the output logic processor to route various band-pass range signals to various vibrator zones in the music massage mat. For the linear mapping mode, the vibrator responds up or down with the audio tone change. The low frequency signal is at one end and the high tone musical instrument tone at the other. This will allow mathematically logical responses, but not always give pleasing vibrator response of massage action. It is known that all parts of the human body are affected by music. Therefore, certain frequency band signals are required to be re-mapped and re-modulated in the operation to drive the vibrators in the mat for the various zones of the body. The set of signals from the threshold detector represents the various frequency ranges from the left and right channels F1, F2, F3, F4, and F5. They are applied to the signal routing logic processor 1601. The signal routing logic may be accomplished by multiplexor (MUX), demux, programmable logic array (PLA), RAM, or EPROM.

FIG. 12A illustrates the linear mapping of input and output signals using the cross bar logic element. In this illustration, the left side signals F1 through F5 are mapped to left side vibrator zones 1 through 5. The right side frequency signals F1 through F5 are mapped to the right side vibrator zone 1 through 5.

FIG. 12B illustrates an example of nonlinear mapping. This re-mapping allows the bass response to map to the lumbar zone area and a tapping high response to map to the leg zone. The post logic processor shown in FIG. 12B allows the programming of different zone patterns according to the type of music. Also it allows dynamic mapping to route not only zone to zone but from the left to right zone.

Routing the left and right side, such as a drum tone with a synchronized beat and rhythm generator (shown in FIG. 10) adds a more rhythmic vibrator response. It synthesizes hands or toe tapping-like beat to the massaging action. The post logic processor allows for Boolean logic operations. For example, high frequency F5 and low frequency input may be "or" gated to zone 3, or zone 2 may be the "XOR" of F2 and F4, etc. There is a further logical operation to differentiate the accentuated left and right side audio signal separation by removing common center audio components portion with a logic operator. Using various mapping, linear and nonlinear signal processing methods and dynamic programming, such a process achieves a synthesized massaging music effect.

FIGS. 13A and 13B illustrate the remote control user interface for the music massager. FIG. 13A shows an example of a control panel 1550 for the music massager, with four mode button selects, which are MUSIC, CYCLE, SPOT and POWER. For each mode, selections are made by pressing the corresponding buttons. For example, after POWER 1504, is turned on, MUSIC 1501, is pressed. This system will default to easy listening and the massager responds softly and gently to the present music signal. If the MUSIC button is pressed again, it will step up to the moderate level. By pressing the MUSIC button a third time, it will select beat 1511, for the high impact level.

Display indicator 1530, may be accomplished by using LEDs or a more flexible LCD display. While the music and beat are in progress, CYCLE 1502, is selected. It will adjust to a faster or slower beat synchronization. If the MUSIC signal is not present, CYCLE will provide wave-like up and down motion. Without MUSIC input, if easy or moderate is selected, the cycling sequence from one zone to the next zone gradually fades up or down to provide a more soothing transition. This fading is accomplished by duty cycle modulation control. SPOT 1503, mode allows a specific zone or spot to increase or decrease intensity to customize the vibrator response to fit the user's desire. In absence of music input, spot mode can operate as manual spot massager mode. Spot selection is made by user pressing the desired spot area on the human body graphics 1550. If the right side shoulder area is to be selected, the user presses the spot area of the body graphic 1551. LED 1551, will light up. It will also activate in the right shoulder zone area of vibrator in the mat. Also, if SPOT 1503, or "+" is selected, it can activate one vibrator at a time. Multiple spots may be added or subtracted when "−" is pressed. In a SPOT program mode the beat pattern may be programmed by depressing a spot area of the body graphics with a short depression. A long depression will cause a longer hold after the beat sequence. Then if CYCLE/MEM is selected, it will play the stored beat or rhythm with music.

FIG. 13B shows an example of the cross bar touch key pad 1570, placed below the control panel of FIG. 13A. Cross bar contacts are placed in rows and columns. If electrical contacts are detected, the system controller will select the mode and indicate the proper LED or display. The system controller can perform logical Boolean and sequential logic to track sequences of the user's command and the massager responds accordingly.

A graphic based interactive touch control panel and LCD menu or Icon driven display can add flexibility and ease of operation. With this feature, the unit can still respond to the desire of the user to modify, add or create additional massage effects.

Another version of the music vibrator controller combines conventional remote control functions. In such an application, all the basic remote commands of turning on the CD or TV, selecting channel and adjusting the volume can be accomplished by an all-in-one Master remote commander.

Figure 14:
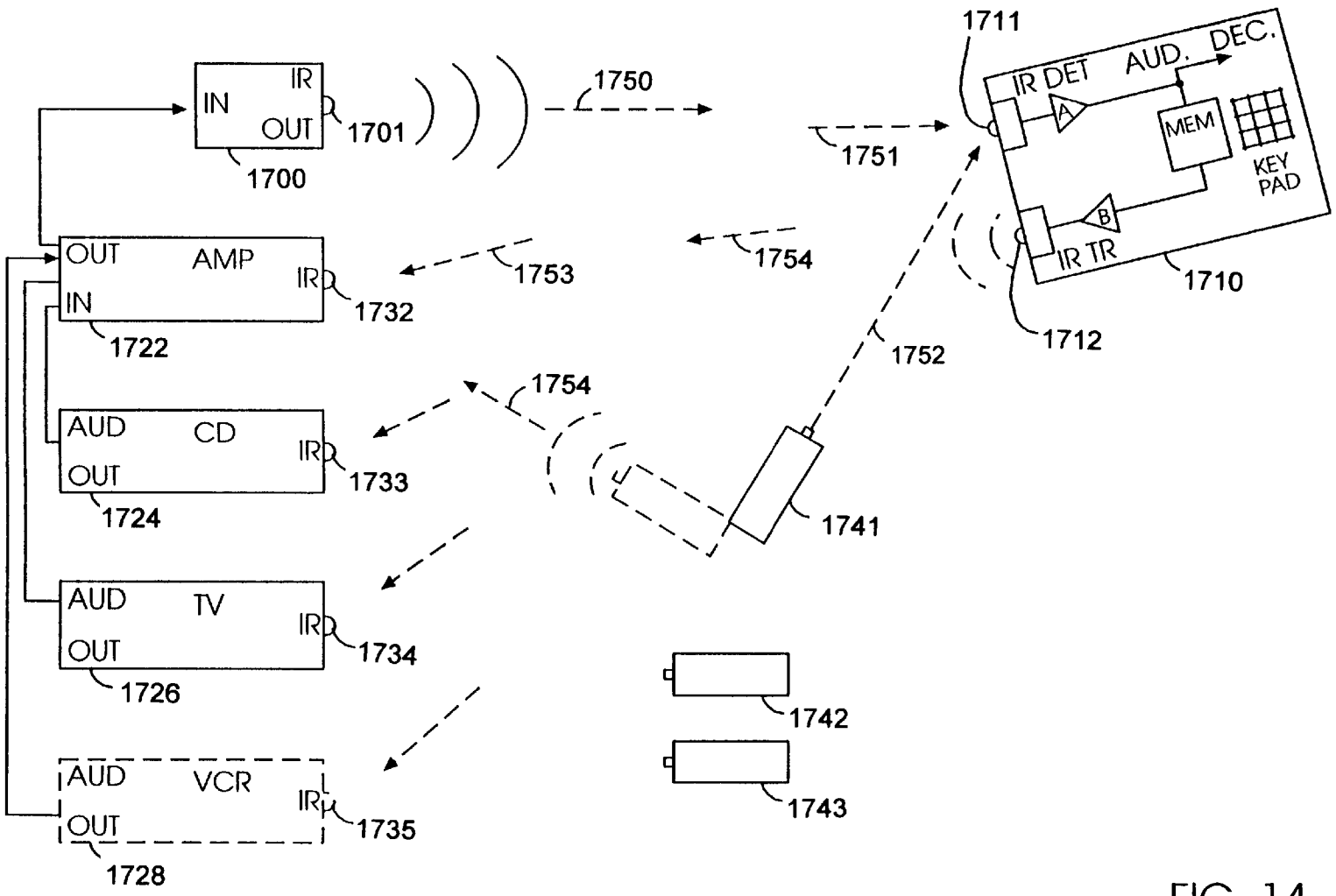
FIG. 14 shows wireless remote audio signal pick off and master remote control of audio video systems.

FIG. 14 illustrates wireless audio signal transmission and also remote control of audio equipment. This configuration will eliminate hard wiring to the speaker or cable hook up between the audio equipment and music massager units. The massager remote control unit can store various code patterns used to control other audio/video equipment. This eliminates the need to use multiple remote controllers for each piece of equipment.

Three functions of the music massager control unit will be explained.

1) wireless remote Audio Coupling.

2) Store specific remote command code patterns.

3) Play back pre-stored remote control code patterns to a specific unit to control audio/visual functions.

Referring to the FIG. 14, in a typical home audio and visual system each unit, such as CD 1724, TV 1726, VCR 1728, sends line output to the main amplifier 1722, and audio output drive speakers. Wireless audio transmitter unit 1700, may be connected to the amplifier's monitor output jack or directly to the left and right channels of speaker terminals.

First, the remote wireless transmitter can transmit an FM modulated RF signal, or emit an infrared beam, to the remote receiving units. For example, shown transmitter 1700, transmits through an IR transmitter diode 1701. This FM modulated light beam is received by IR detector 1711, in the controller unit 1710. The detected FM coded audio signal is amplified and sent to the FM demodulator to recover the left and right audio channels. The remote IR signal transmitter/receiver and modulation demodulation techniques are well understood by the people in the art. Therefore, a detailed explanation will not be given here. The demodulated and reconstructed left and right channel signals will be used to activate the Music Massager.

Second, in order to eliminate the use of several remote control units, the IR code from each unit is used to program the master controller. All in one, or master controller, techniques exist today and are a known practice in the audio/visual field. For example the main amplifier remote unit 1741, is placed in front or in line with the music controller IR detector 1711, to transfer command code. To reprogram the selected remote function key press "program" on the controller unit 1710. Next, send the key code from the original system remote control unit 1741, specific button. This will send a very specific code from the original manufacture's remote to the receiving music remote memory location. This procedure can be repeated to transfer the command mode from any remote unit, such as a CD remote 1742, or a TV remote 1743.

Third, play back stored code in the memory by switching the unit from "program" to "command" on the music controller unit. Music command unit may have an Alpha Numeric LCD display with back illumination that allows flexibility in use and ease of menu. The menu may be graphically show in LCD display.

In remote "command" mode for audio and visual equipment, a function such as Vol+, with the code stored in memory in music controller unit 1710, will send bit stream through an amplifier to the IR transmitter 1712. This IR code will be detected by most audio and visual units, however, only applicable units will respond to the specific command code. The master remote control can feature greatly eases the use of massager unit. One master controller unit can select and command any CD, video channel or audio volume. Once the audio or music is selected, the user can relax with music and sound vibrating massager, or get a real physical, adventurous experience with video play.

Figure 15:
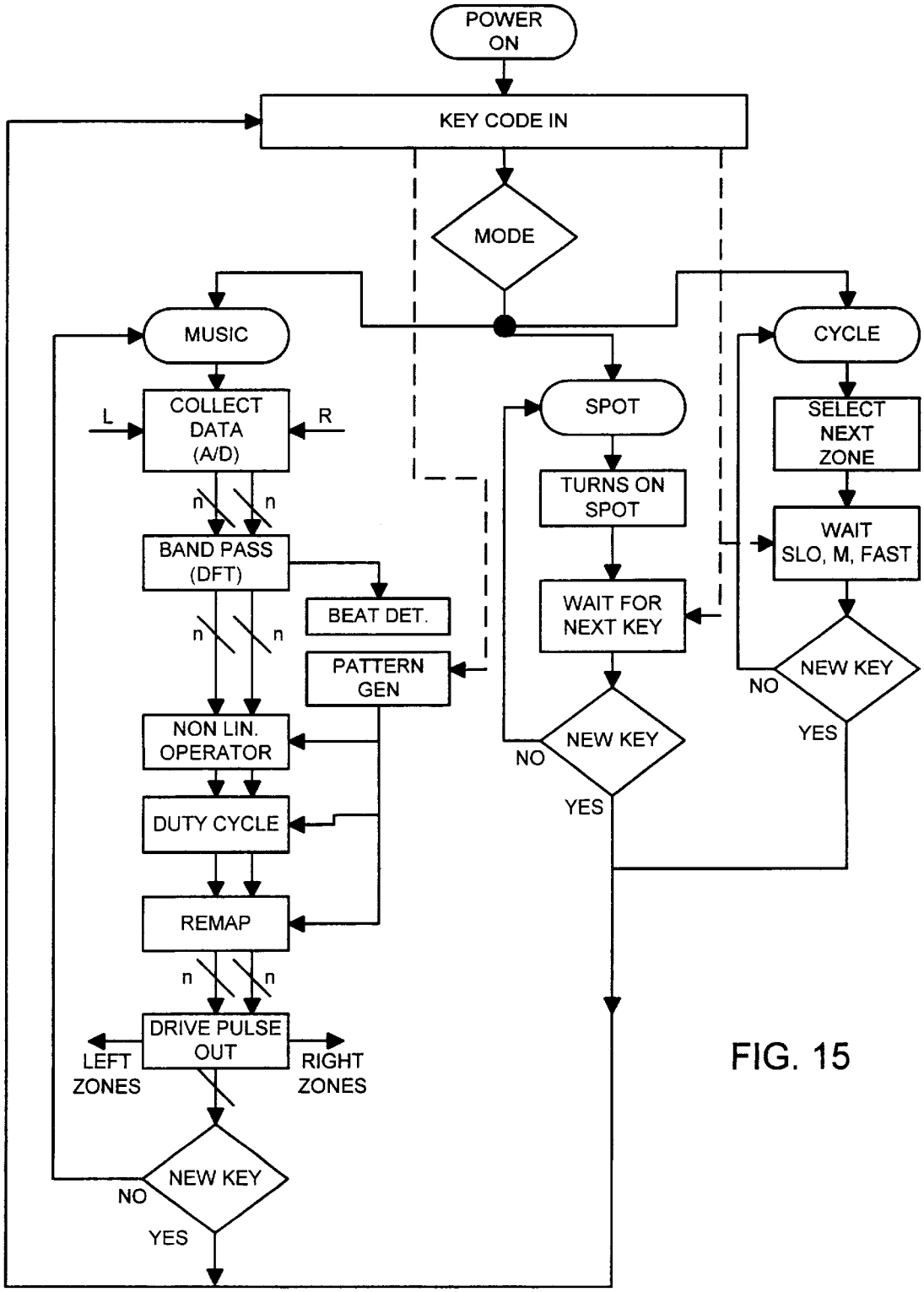
FIG. 15 shows a simplified flow chart of the music massager system process which may be implemented by DSP chips and/or microprocessors.

FIG. 15 shows a simplified flow chart of the Music Massage system process which may be implemented by DFT chip, or microprocessor (shown previously in FIG. 4). Briefly, after the power is turned on, the key code detector selects the mode, MUSIC, SPOT or CYCLE. In the music mode, an audio signal from the left and right channel is digitized by A/D. Samples are processed through the DFT or Band-Pass Filter resulting in several frequency ranged data for both the left and right channels.

Frequency discriminated data is further processed through non-linear operator to detect the amplitude of the signal non-linear gain and time stretch operations are performed. The linearly or non-linearly processed signal is processed through the duty cycle calculator to convert the amplitude related data to the pulse-width modulated pulses for all data. The duty cycle modulated data is processed through the re-mapping process to reroute the data to the output driver to the set of vibrators. This process is repeated until a new key command is detected. It continues to activate the vibrators according to the music or sound signals and predetermined logical rules of signal processing.

In the SPOT mode of operation, if a spot button is pressed, a specific spot location is stored in the memory. It will continue to loop and detect the new key sequence. The spot key detector can also detect the length of depression of the key by the user, and will store the information in the key pattern sequence. Once the beat sequence is stored in the beat pattern memory, then the user generated beat pattern sequences may be played back. It can modulate or modify the rhythmic beat processing. The signal processing and re-mapping processor is used to create music synthesized massage operations.

Depending on which button (slow, medium or fast) has been activated in the cycle mode, it will adjust the beat rate loaded in by the beat detector. It allows increasing or decreasing tempo of vibrator action. In absence of the music signal, the cycle mode can enable a wave-like vibrator cycling of the vibrator motion from one zone to the next in sequence.

In summary, this invention described provides new experience in vibrator massage by providing a massage vibrator that responds to various music rhythms, beats, soft or hard, stimulating a full spectrum of massage action to all zones of the body. With audio and visual input the mastery of the music artist's perfection can now be transformed to massage and vibrating sensations to provide a new connection to the human body.

While plural embodiments of the present invention have been shown and described, it will be apparent to those skilled in the art that many changes and modifications may be made without departing from the invention in its broader aspects. The appended claims are therefore intended to cover all such changes and modifications as fall within the true spirit and scope of the invention.

What is claimed is:

1. A music massager system which responds to audio signals by detecting the frequency and amplitude of audio components and processing audio components of a signal to generate and further enhance a massaging action, comprising:

Band-Pass discriminator means to detect the signal frequency range of the signal through an analog Band-Pass filter, digital frequency discriminator;

a signal detector to detect the presence of the signal and provide a digital output;

a signal contrast enhance means to provide nonlinear input and output relationship; and a controller means to control the system function's process.

2. A music massager system according to claim 1 wherein said signal detector is selected from the group consisting of a comparator, a gate, and a Schmitt Gate.

3. A music massager system according to claim 1 further comprising:

a signal envelope detector means comprising a diode, a capacitor and a resistor to retain a peak value and allowing decay at a controlled rate; and a threshold detector means.

4. A music massager system according to claim 1 further comprising:

a threshold detector; and a pulse-width stretcher means.

5. A music massager system according to claim 4 wherein said pulse-width stretcher means comprises a timer.

6. A music massager system according to claim 1 further comprising:

a duty cycle modulator means to adjust the pulse-width duty cycle of the signal.

7. A music massager system according to claim 1 further comprising:

a multiple threshold detector means to create various output signals from various detector bias levels; and a logic operator means to perform Boolean logic operation of level detected signal.

8. A music massager system according to claim 1 further comprising:

a music mood selector means to select different vibrator response contrast methods to match the music selected by the user.

9. A music massager system according to claim 8 wherein said music mood selector means enables selection of at least easy listening, pop or rock music styles.

10. A music massager according to claim 8 further comprising:

a beat rate generator means.

11. A music massager according to claim 10 wherein said beat rate generator means comprises a variable frequency generator.

12. A music massager according to claim 11 further comprising:

plural frequency dividers in a phase lock loop to provide a stepped up output frequency of the VCO; and a programmable frequency counter of K and M divider to create modulo K and modulo M sub-beat frequencies of the stepped up VCO frequency.

13. A music massager according to claim 12 wherein said massager generates:

a higher harmonic beat greater than an original music beat;

a substantially same beat frequency as the original music beat; and a sub-harmonic beat of the original music beat.

14. A music massager system according to claim 1 further comprising:

a micro controller or microprocessor means to perform at least portions of the band-pass discrimination signal detection, nonlinear signal transfer function and system control.

15. A music massager system that responds to audio signals, audio processing detecting the music beat and re-creating multiple beat harmonics and combines synchronously with pre-stored beat rhythm pattern or user programmed beat pattern to create re-synthesized massage action comprising:

a band-pass detector means;

a signal detector means;

a beat detector means;

a beat regenerator means;

a signal flow modifier means;

a signal strength modulation means;

a programmable means to store preset or user programmed functions;

a vibrator drive means; and a controller means to control all functions of the music massager to activate the vibrator drive means in sync with music.

* * * * *